US008011301B1

(12) United States Patent
Sloan

(10) Patent No.: US 8,011,301 B1
(45) Date of Patent: Sep. 6, 2011

(54) CARTRIDGE FOR A FIREARM

(76) Inventor: Jimmie Sloan, Porter, TX (US)

( * ) Notice: Subject to any disclaimer, the term of this patent is extended or adjusted under 35 U.S.C. 154(b) by 493 days.

(21) Appl. No.: 12/038,701

(22) Filed: Feb. 27, 2008

Related U.S. Application Data

(60) Provisional application No. 60/892,005, filed on Feb. 28, 2007.

(51) Int. Cl.
*F42B 5/32* (2006.01)
*F42B 5/26* (2006.01)

(52) U.S. Cl. ..... 102/464; 102/430

(58) Field of Classification Search ..... 102/464, 102/468, 469, 470, 430; 86/1.1, 10
See application file for complete search history.

(56) References Cited

U.S. PATENT DOCUMENTS 6,354,221 B1 * 3/2002 Jamison ..... 102/430
6,679,150 B1 * 1/2004 Ramirez et al. ..... 86/1.1

OTHER PUBLICATIONS

The RCBS.Load Cartridge Designer Utility, published on internet Apr. 30, 2001, http://www.gmdr.com/rcbs/rcbstext9.htm.*

* cited by examiner

*Primary Examiner* — James Bergin
(74) *Attorney, Agent, or Firm* — Parsons & Goltry; Robert A. Parsons; Michael W. Goltry

(57) ABSTRACT

A cartridge case for a firearm is formed to contain a .338 caliber bullet. The case includes a cylindrical body portion with a central aperture in the head end for receipt of a primer and a cartridge extraction groove formed around the periphery of the body portion adjacent the head end. A frusto-conical shoulder portion tapers radially inwardly from the body portion and a generally cylindrical neck portion extends longitudinally from the shoulder portion. The length of the body portion is approximately 1.8813 inches and the outside diameter of the body portion at the shoulder portion is 0.5709±0.0059 inches. The length of the shoulder portion is 0.2727 inches. The length of the neck portion is 0.3381 inches and the outside diameter of the neck portion is 0.3669 inches. The case encloses a volume designed to receive an amount of propellant in a range of 82.0 grns to 97.8 grns.

8 Claims, 4 Drawing Sheets

CARTRIDGE FOR A FIREARM

FIELD OF THE INVENTION

This invention generally relates to ammunition for firearms and a reamer for forming a firing chamber in the firearm to receive the ammunition.

BACKGROUND OF THE INVENTION

In the firearm and ammunition industry, the cartridge for a firearm is essential in determining the speed and power of the bullet once the firearm is fired. Clearly, bullet speed and power can be affected by changing the size of the shell and the amount of propellant, such as gun powder, carried by the shell. However, it is equally clear that increases in the size of the shell and the amount of powder have an upper limit. Also, as the size of the shell and amount of powder increases the size of the firearm in which the cartridge is used must increase resulting in a less versatile instrument.

It would be highly advantageous, therefore, to remedy the foregoing and other deficiencies inherent in the prior art.

Accordingly, it is an object of the present invention to provide a new and improved cartridge for a firearm.

It is another object of the present invention to provide a new and improved cartridge for a firearm that maximizes powder combustion and direction of the propellant gasses.

Another object of the invention is to provide a new and improved cartridge for a firearm that maximizes powder combustion and direction of the propellant gasses without substantially increasing the size of the shell or the amount of powder contained therein.

Another object of the invention is to provide a new and improved cartridge for a firearm that improves projectile or bullet accuracy for longer ranges.

SUMMARY OF THE INVENTION

Briefly, to achieve the desired objects and advantages of the present invention a cartridge case for a firearm is formed to contain a .338 caliber bullet. The case includes a head end and a mouth end longitudinally separated. A cylindrical body portion extends longitudinally from the head end toward the mouth end and has a central aperture in the head end for receipt of a primer in communication with an interior volume. A cartridge extraction groove is formed around the periphery of the body portion adjacent the head end. A frusto-conical shoulder portion is formed integral with the body portion and extends longitudinally from the body portion. The shoulder portion tapers radially inwardly from the body portion to a generally cylindrical neck portion extending longitudinally from the shoulder portion to terminate at the mouth portion. The length of the body portion is approximately 1.8732–1.8813 inches with an outside diameter at the shoulder portion being 0.5709±0.0059 inches. The length of the shoulder portion is 0.2727 inches. The length of the neck portion is 0.3381 inches with the outside diameter being 0.3669 inches. The case encloses a volume designed to receive an amount of propellant in a range of 82.0 grns to 97.8 grns.

To further achieve the desired objects and advantages of the present invention a reamer is provided for use in forming a firing chamber in a firearm. The reamer includes a longitudinally extending cylindrical body portion, a frusto-conical shoulder portion extending longitudinally from the body portion and tapering radially inwardly from the body portion, and a generally cylindrical neck portion extending longitudinally from the shoulder portion. The reamer is designed to form the firing chamber with a longitudinally extending, cylindrical body portion, a frusto-conical shoulder portion formed integral with the body portion and extending longitudinally from the body portion, and a generally cylindrical, bullet receiving neck portion extending longitudinally from the shoulder portion. Further, the length of the body portion that is formed by the reamer is approximately 1.8732 inches with the outside diameter of the body portion at the shoulder portion being 0.577±0.0059 inches. The length of the shoulder portion is approximately 0.2748 inches. The length of the neck portion is approximately 0.354 inches with the outside diameter of the neck portion being 0.3645–0.367 inches and the overall length of the case being 2.502 inches±0.0118 inches.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
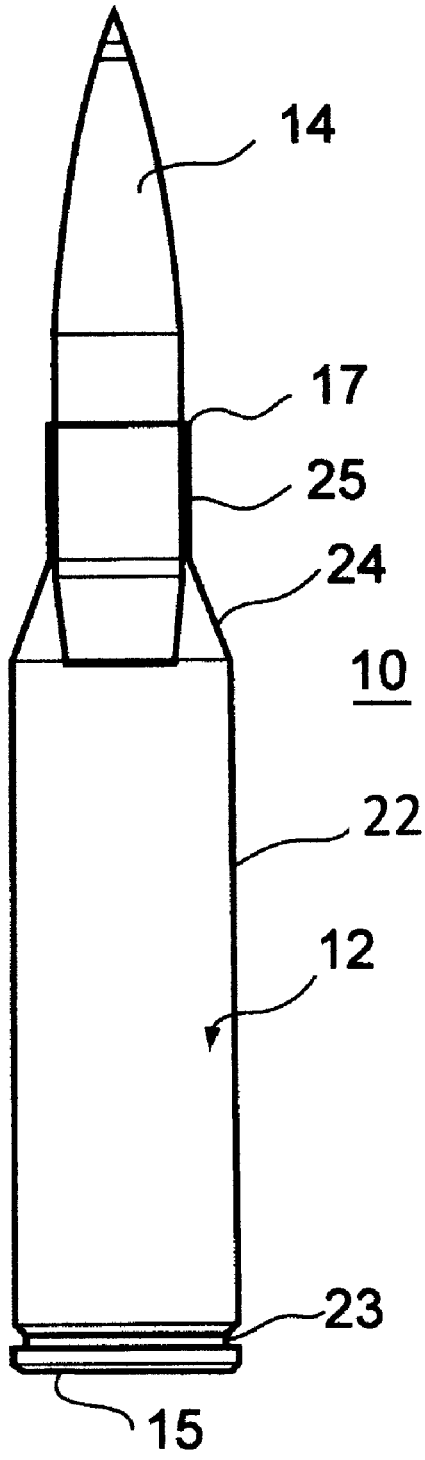
FIG. 1 is a plan view of a cartridge in accordance with the present invention.
Figure 2:
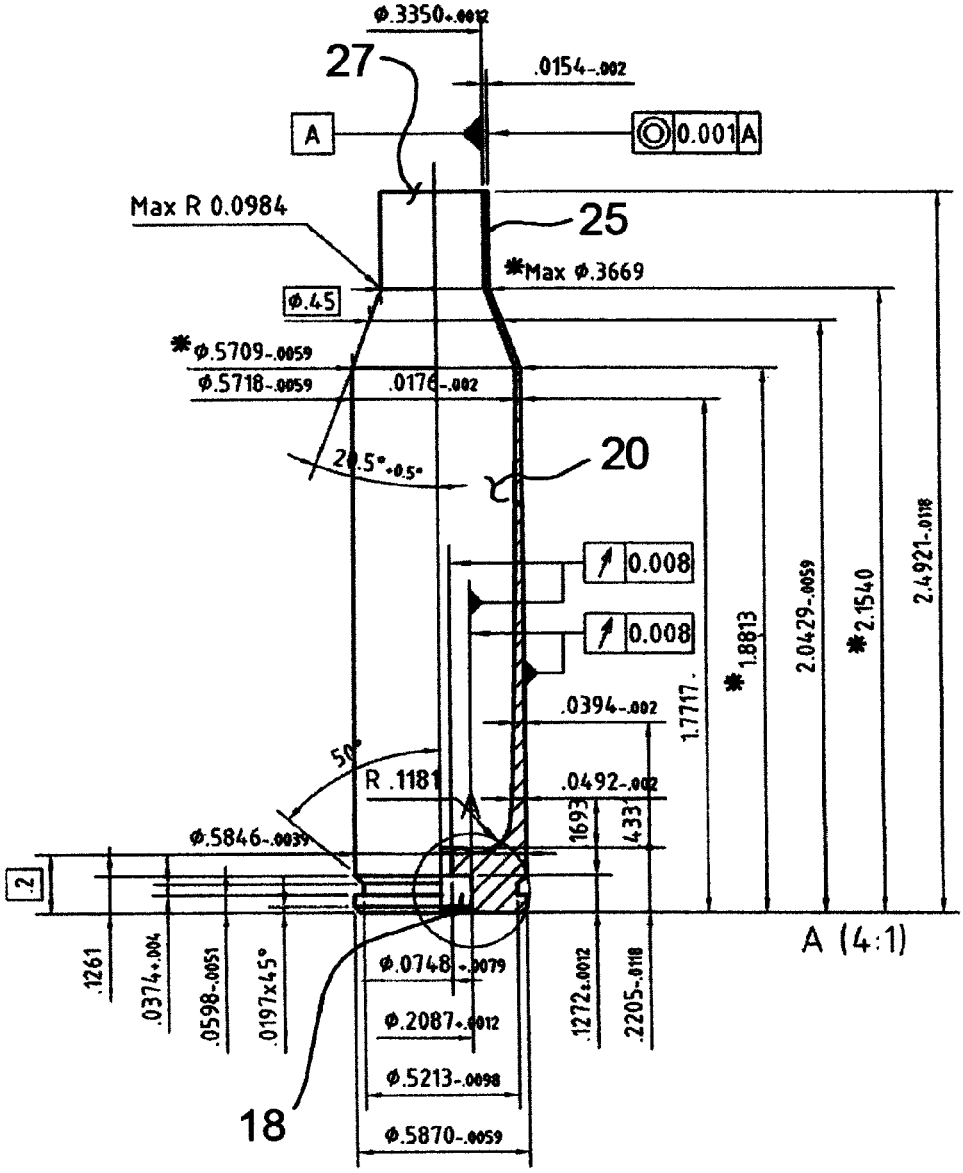
FIG. 2 is a side view in partial section of the case of the cartridge of FIG. 1 in an unfired configuration.

Turning now to the drawings, attention is first directed to FIGS. 1 and 2 which illustrate a cartridge, generally designated 10, in accordance with the present invention. Cartridge 10 includes a case 12 and a bullet 14. Bullet 14, in this embodiment, is a 300 gr Sierra. Case 12 is generally a hollow cylinder having a restricted neck and preferably formed of brass. Case 12 includes a head end 15 and a mouth end 17. Head end 15 includes a central aperture 18 for receipt of a primer (not shown). A generally cylindrical body portion 22 extends from head end 15 to a frusto-conical shoulder 24. Central aperture 18 is in communication with an interior volume 20 defined by case body portion 22. A cartridge extraction groove 23 is formed around the periphery of body portion 22 proximate head end 15. Shoulder 24 is tapered from body portion 22 to a generally cylindrical neck portion 25. Neck portion 25 has a diameter smaller than the diameter of body portion 15 and terminates in an open mouth 27.

Bullet 14 is carried by neck portion 25, substantially filling neck portion 25, with a portion of bullet 14 extending into body portion 22 approximately the length of shoulder 24. Bullet 14 extends the length of neck portion 25 and also extends beyond mouth end 17 of case 12 more than one half the total length of bullet 14.

Figure 3:
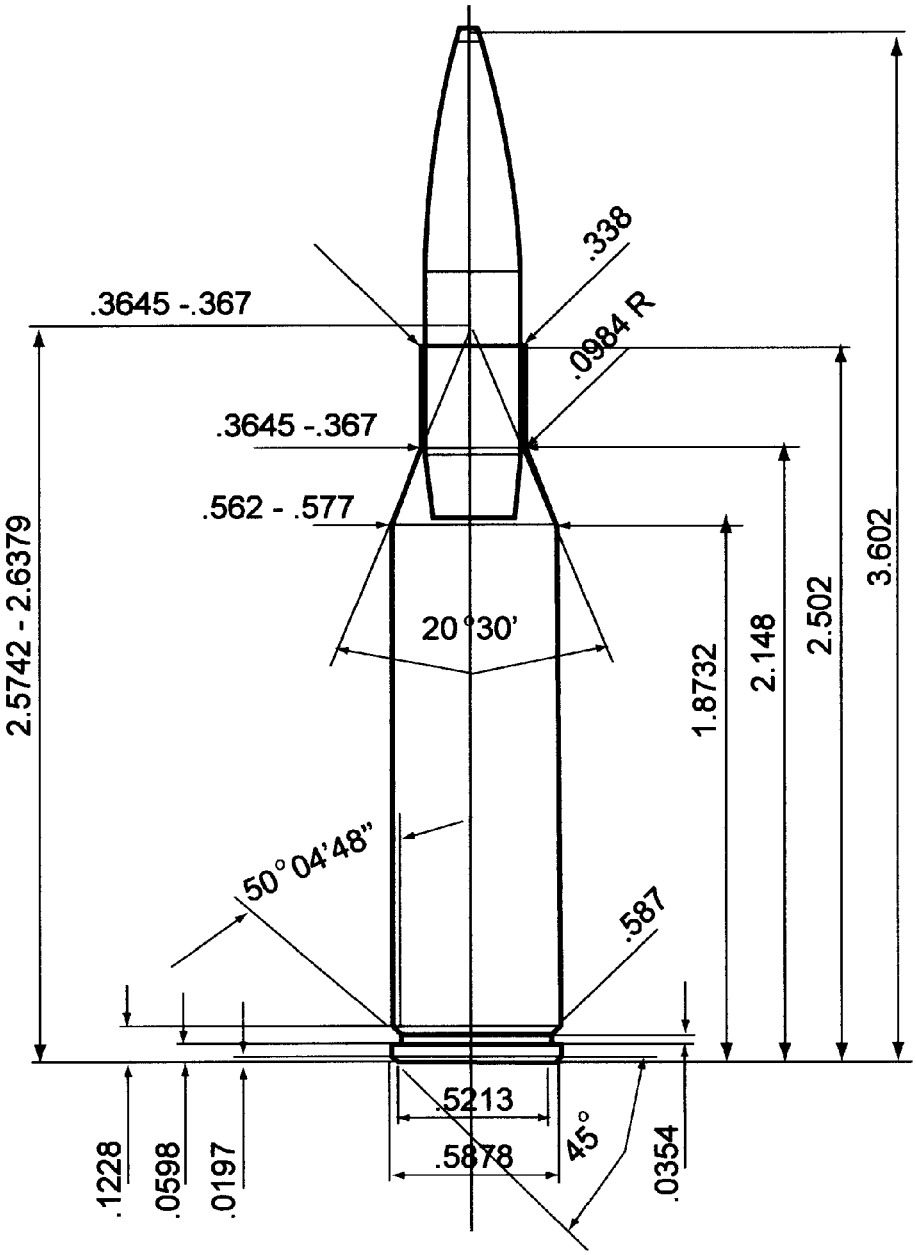
FIG. 3 is a schematic illustration of the cartridge of FIG. 1 in a loaded configuration.

Case 12 has nominal dimensions intended to establish a standard cartridge type. Variations from the nominal dimensions are tolerated by minimal deviations. The dimensions of cartridge 10 are described using a pre-fired schematic of cartridge case 12 (FIG. 2), a schematic of a loaded cartridge case 12 (FIG. 3), and the schematic of a chamber reamer, designated 40 (FIG. 4) indicating the dimensions of case 12 at the largest end of the spectrum. All dimensions illustrated and described are in inches.

While the various dimensions and the ranges or tolerance are indicated on the drawings, the major dimensions in a preferred embodiment include the diameter of body portion 22, the length of case 12 from head end 15 to shoulder 24, and the angle of shoulder 24 relative to the longitudinal axis of cartridge 10. These dimensions can change between an unfired cartridge and a loaded case 12.

Specifically, the outside diameter of body portion 22 at the beginning of shoulder 24 of an unfired case 12 (FIG. 2) is 0.5709±0.0059, with a length from head end 15 to shoulder 24 of 1.8732–1.8813. In the loaded case 12 (FIG. 3), body portion 22 has an outside diameter at the beginning of shoulder 24 of 0.562–0.577 and a length from head end 15 to shoulder 24 of 1.8732. It will be noted that the outside diameter of body portion 22 at head end 15 is 0.5870±0.0059 in the unfired case 12 and 0.5878 in the loaded case 12 to illustrate some variation, and to produce a very slight taper in body 12 from shoulder 24 to head end 15, the taper being included normally to hold cartridge 10 snuggly in a firing chamber once it has been inserted.

Shoulder 24 tapers from body portion 22 at an angle, relative to the longitudinal axis of cartridge 10, of 20.5°±0.05° in an unfired case 12 and tapers at an angle, relative to the longitudinal axis of cartridge 10, of 20.30° in a loaded case 12. The length of shoulder 24 is 0.2727 in an unfired case 12 and 0.2748 in a fired case 12. Shoulder 24 tapers from the outside diameter of body portion 22 to a maximum diameter of 0.3669 of neck portion 25 in an unfired case 12. In a loaded case 12, the outside diameter of neck portion 25 is 0.3645–0.367. Case 12 has a thickness of 0.0492±0.002 at head end 15 and tapers substantially uniformly to a thickness of 0.0154±0.002 at mouth end 17. Here it will be understood that the thickness of case 12 tapers to a minimum thickness adjacent mouth end 17 so that the inside diameter of mouth 17 is 0.3381 in an unfired case 12 and is, thus, formed to contain a .338 caliber bullet.

In use, cartridge 10 is placed within a properly sized chamber of a firearm (not shown). Interior volume 20 of cartridge 10 contains a propellant charge of material, such as gun powder. When a firing pin of the firearm contacts the primer of cartridge 10, the primer detonates, igniting the propellant charge carried within case 12 and propelling bullet 14 from case 12. In the present embodiment, a .338 caliber 300 gr Sierra bullet is propelled by 82.0 to 97.8 grns of powder.

It has been found through extensive experimentation and firing that the maximum accuracy for longer ranges of a .338 caliber bullet is achieved in a cartridge with a cylindrical body portion extending longitudinally from the head end to a frusto-conical shoulder portion formed integral with the body portion and a generally cylindrical neck portion extending longitudinally from the shoulder portion to the mouth end and formed integral with the neck portion. To further achieve the maximum powder combustion and direction of the propellant gasses it was found that the choice outside diameter of the body portion at the beginning of the shoulder of an unfired case is 0.5709±0.0059 and the outside diameter of the body portion at the head end is 0.5870±0.0059. Also, a choice body portion length is 1.8813 with the length of the shoulder being 0.2727 and the overall length being 2.4921±0.0118.

Figure 4:
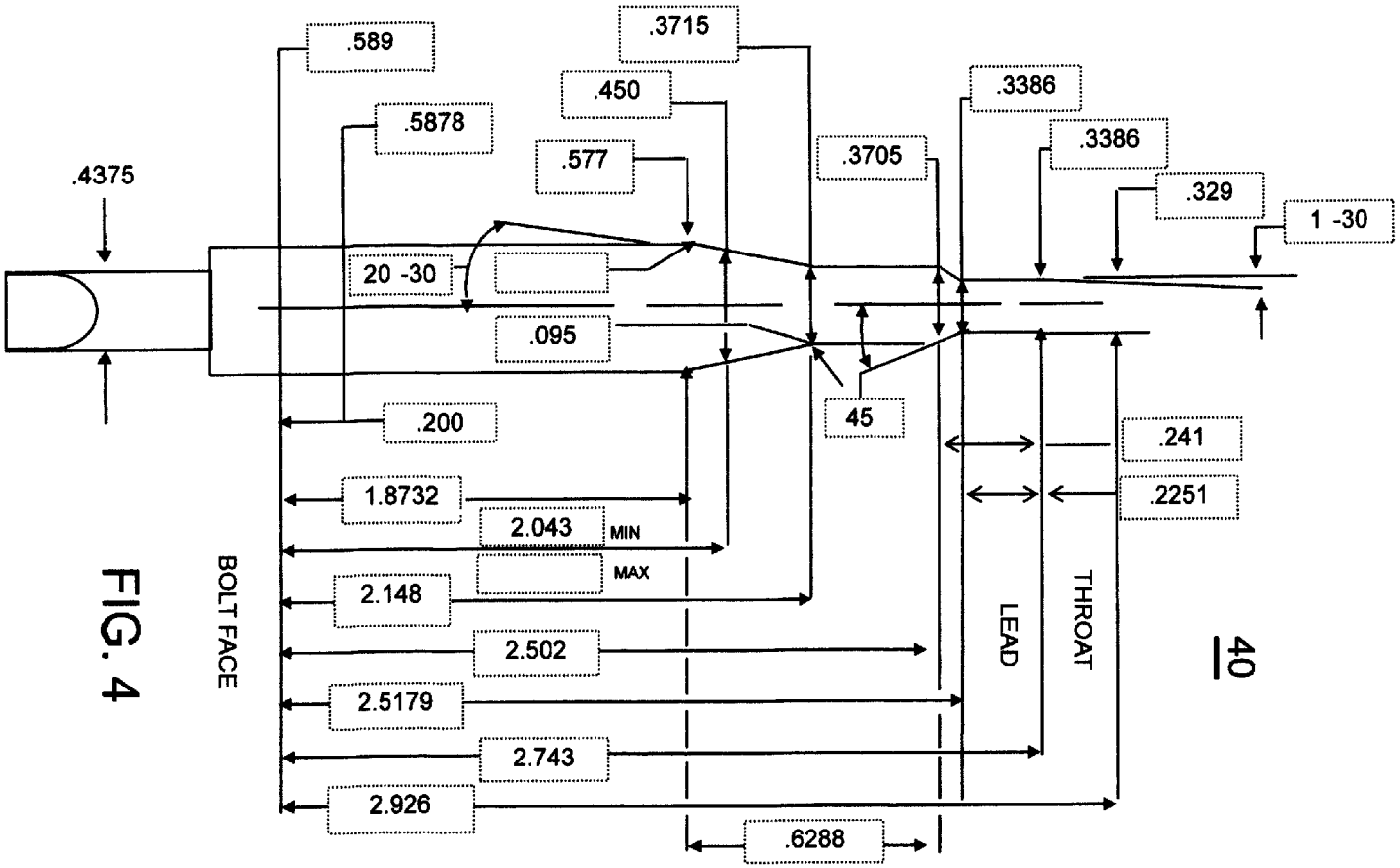
FIG. 4 is a schematic illustration of a reamer for use with the cartridge of FIG. 1.

Turning to FIG. 4, a reamer 40 is illustrated that is specifically designed to ream or form a firearm chamber into a chamber compatible with cartridge 10. To this end, it will be noted that the chamber has dimensions slightly larger than an unfired cartridge 10. When cartridge 10 is fired in the chamber formed with reamer 40 the fired dimensions set forth above are achieved. The unfired to fired dimensions, along with the original form, are specifically calculated to maximize powder combustion and direction of the propellant gasses.

Thus, a new and improved new and improved cartridge for a firearm is disclosed that maximizes powder combustion and direction of the propellant gasses. By carefully designing the length of the various components and the diameters of the cartridge, the maximum efficiency of the cartridge can be achieved. The new and improved cartridge maximizes powder combustion and direction of the propellant gasses without substantially increasing the size of the shell or the amount of powder contained therein. Further, the new and improved cartridge improves projectile or bullet accuracy for longer ranges.

Various changes and modifications to the embodiment herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A cartridge case, with a head end and a mouth end longitudinally separated, for a firearm and formed to contain a .338 caliber bullet, the case including:

a cylindrical body portion extending longitudinally from the head end toward the mouth end and having a central aperture in the head end for receipt of a primer in communication with an interior volume, and a cartridge extraction groove formed around the periphery of the body portion adjacent the head end;

a frusto-conical shoulder portion formed integral with the body portion and extending longitudinally from the body portion toward the mouth end, the shoulder portion tapering radially inwardly from the body portion;

a generally cylindrical, bullet receiving neck portion extending longitudinally from the shoulder portion to the mouth end and terminating at the mouth end;

the length of the body portion being approximately 1.8732–1.8813 inches and the outside diameter of the body portion at the shoulder portion being 0.5709±0.0059 inches, the length of the shoulder portion being approximately 0.2727 inches, the length of the neck portion being approximately 0.3381 inches, and the outside diameter of the neck portion being 0.3669 inches, with the overall length of the case being 2.4921±0.0118; and the case enclosing a volume designed to receive an amount of propellant in a range of 82.0 grns to 97.8 grns.

2. A cartridge case as claimed in claim 1 wherein the outside diameter of the body portion at the head end is 0.5870±0.0059 and the overall length is 2.4921±0.0118.

3. A cartridge case as claimed in claim 1 wherein the shoulder portion tapers radially inwardly from the body portion at an angle, relative to the longitudinal axis of the cartridge, of 20.5°±0.05°.

4. A cartridge case as claimed in claim 1 wherein the cartridge case has a thickness of 0.0492±0.002 at the head end and tapers substantially uniformly to a thickness of 0.0154±0.002 at the mouth end.

5. A cartridge case as claimed in claim 1 wherein the length of the body portion after loading is approximately 1.8732 inches with the outside diameter of the body portion at the shoulder portion being 0.577±0.0059 inches, the length of the shoulder portion being approximately 0.2748 inches, and the length of the neck portion being approximately 0.354 inches with the outside diameter of the neck portion being 0.367 inches and the overall length of the case being 2.502 inches±0.0118 inches.

6. A cartridge case for a firearm with a head end and a mouth end longitudinally separated, the case including:

a cylindrical body portion extending longitudinally from the head end toward the mouth end and having a central aperture in the head end for receipt of a primer in communication with an interior volume, and a cartridge extraction groove formed around the periphery of the body portion adjacent the head end;

a frusto-conical shoulder portion formed integral with the body portion and extending longitudinally from the body portion toward the mouth end, the shoulder portion tapering radially inwardly from the body portion;

a generally cylindrical, bullet receiving neck portion extending longitudinally from the shoulder portion to the mouth end and terminating at the mouth end;

the length of the body portion being approximately 1.8813 inches, the outside diameter of the body portion at the shoulder portion being 0.5709±0.0059 inches, and the outside diameter of body portion at the head end being 0.5870±0.0059;

the length of the shoulder portion being approximately 0.2727 inches and the shoulder portion tapering from the body portion radially inwardly at an angle, relative to the longitudinal axis of the cartridge, of 20.5°±0.05°;

the length of the neck portion being approximately 0.3381 inches and the outside diameter of the neck portion adjacent the shoulder being 0.3669 inches, and the inside diameter of the neck portion at the mouth end being formed to receive a .338 caliber bullet, with the overall length of the case being 2.4921±0.0118; and the case enclosing a volume designed to receive an amount of propellant in a range of 82.0 grns to 97.8 grns.

7. A cartridge case as claimed in claim 6 wherein the cartridge case has a thickness of 0.0492±0.002 at the head end and tapers substantially uniformly to a thickness of 0.0154±0.002 at the mouth end.

8. A cartridge case as claimed in claim 6 wherein the length of the body portion after firing is approximately 1.8732 inches with the outside diameter of the body portion at the shoulder portion being 0.577±0.0059 inches, the length of the shoulder portion being approximately 0.2748 inches, and the length of the neck portion being approximately 0.354 inches with the outside diameter of the neck portion being 0.367 inches and the overall length of the case being 2.502 inches±0.0118 inches.

* * * * *